US008197089B2

(12) United States Patent
Chang et al.

(10) Patent No.: US 8,197,089 B2
(45) Date of Patent: Jun. 12, 2012

(54) LED LAMP

(75) Inventors: Kun-Jung Chang, Kaohsiung County (TW); Ching-Yuan Juan, Kaohsiung County (TW); Kuo-Chun Lin, Kaohsiung County (TW); Ching-Huang Juan, Kaohsiung County (TW)

(73) Assignee: Li-Hong Technological Co., Ltd., Kaohsiung County (TW)

( * ) Notice: Subject to any disclaimer, the term of this patent is extended or adjusted under 35 U.S.C. 154(b) by 193 days.

(21) Appl. No.: 12/794,179

(22) Filed: Jun. 4, 2010

(65) Prior Publication Data

US 2011/0299286 A1 Dec. 8, 2011

(51) Int. Cl.

| | |
|---|---|
| ***F21S 4/00*** | (2006.01) |
| ***F21V 21/00*** | (2006.01) |
| ***F21V 29/00*** | (2006.01) |
| ***F21V 7/20*** | (2006.01) |

(52) U.S. Cl. ..... 362/249.02; 362/218; 362/294

(58) Field of Classification Search ..... 362/249.03, 362/294, 373, 311.02, 341, 225, 650, 249.02, 362/218

See application file for complete search history.

(56) References Cited

U.S. PATENT DOCUMENTS

2008/0278941 A1* 11/2008 Logan et al. ..... 362/234
2009/0185374 A1* 7/2009 Wu et al. ..... 362/249.06

* cited by examiner

*Primary Examiner* — David Crowe

(74) *Attorney, Agent, or Firm* — Muncy, Geissler, Olds & Lowe, PLLC

(57) ABSTRACT

An LED lamp at least includes an LED lamp set and an adjustment assembly. The LED lamp set includes an LED set and a cooling set. The LED set includes at least one LED lamp element which is replaceable individually and a holder to hold the LED lamp element. The cooling set is fastened to the holder. The adjustment assembly includes an adjustment member and an adjustment holder that contain mating engaging portions engageable with each other. The adjustment member is coupled with the adjustment holder and the LED lamp set to provide adjustment function of light illumination angle. The invention further includes an assembly dock coupled with a plurality of LED lamp sets and adjustment assemblies according to requirements to enhance expandability and usability. The structure thus formed can be assembled and disassembled easily, and also provides greater expandability, replacement capability and practicality.

5 Claims, 21 Drawing Sheets

LED LAMP

FIELD OF THE INVENTION

The present invention relates to an LED lamp and particularly to an LED lamp that is expandable and replaceable.

BACKGROUND OF THE INVENTION

With constant progress of society and advance of technology, and increasing environmental consciousness, energy saving and carbon reduction have become vital issue and goal people regard highly and struggle for in all countries around the world.

Since white light LED was developed and introduced in 1990s, its merits such as sturdy and less likely to be shattered, consumed less electric power, mercury-free and eco-friendly, smaller size, applicable in low temperature environments, providing directional light, less light pollution and rich color selections and the like have make it an excellent substitute for the conventional light bulb.

LED has lifespan more than fifty thousand hours and is dozen times longer than the one thousand hours of the conventional incandescent bulb and ten thousand hours of the fluorescent lamp, thus greatly reduces replacement cost of lamp sets.

However, the conventional lighting fixture adopted LED lamps mostly has a plurality of LEDs directly soldered on a circuit board to form an LED module. If damage occurs, the LED cannot be replaced individually. Hence repair and maintenance cost is higher. This becomes its main disadvantage.

Moreover, the conventional LED street lamp is formed by assembling the LED modules soldered on a circuit board as previously discussed, its projecting range and angle are limited. Hence its usability and applicability also leave a lot to be desired.

To remedy the aforesaid drawbacks, the Applicant has submitted a novel design in U.S. patent application Ser. No. 12/558,228 entitled "Improved LED lamp electrode structure" that provides a feature and advantage of individual replacement, thus overcomes the shortcoming of the conventional LED lamp that requires replacement of the entire LED set when malfunction occurs. Therefore repairs and maintenance cost can be reduced.

SUMMARY OF THE INVENTION

The primary object of the present invention is to overcome the disadvantage of conventional LED lamp in illumination by incorporating the concept of U.S. patent application Ser. No. 12/558,228 entitled "Improved LED lamp electrode structure" submitted by the Applicant to provide a novel LED lamp element that can be individually mounted onto a holder to form an LED lamp set to couple with an adjustment assembly with mating male and female engaging portions to provide angle adjustment function for illumination. It also can be coupled with an assembly dock to further improve applicability and practicability.

To achieve the foregoing object, the invention provides an LED lamp that at least includes an LED lamp set and an adjustment assembly. The LED lamp set includes an LED set and a cooling set. The LED set includes at least one replaceable LED lamp element and a holder to hold the LED lamp element.

The adjustment assembly includes an adjustment member and an adjustment holder that have mating male and female engaging portions. After the LED lamp set and the adjustment assembly are coupled, it can be swiveled 360 degrees to adjust illumination angle. It also can be coupled with an assembly dock formed and produced by molding to mate with the number of the LED lamp set and adjustment assembly to provide replacement capability and simpler installation. Thus light illumination angle can be adjusted easily and expandability and practicability are also improved.

In short, the LED lamp according to the invention provides many benefits, notably:

1. Simpler assembly and disassembly, and lower repairs and maintenance cost: with the LED lamp element can be replaced individually, assembly and disassembly are simpler and can be done quickly to overcome the shortcoming of the conventional LED module that requires whole set replacement. Thus time and cost of repairs and maintenance can be reduced.

2. Modular and customized production: the invention provides excellent expandability and practicability, and can be fabricated in a modular fashion to meet different requirements.

3. Greater applicability: with the adjustment assembly providing the mating male and female engaging portions, the LED lamp set can be coupled with the adjustment assembly to provide individual adjustment of illumination angle. By incorporating with the assembly dock, illumination range and width can be increased to meet requirements of varying installation angles.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
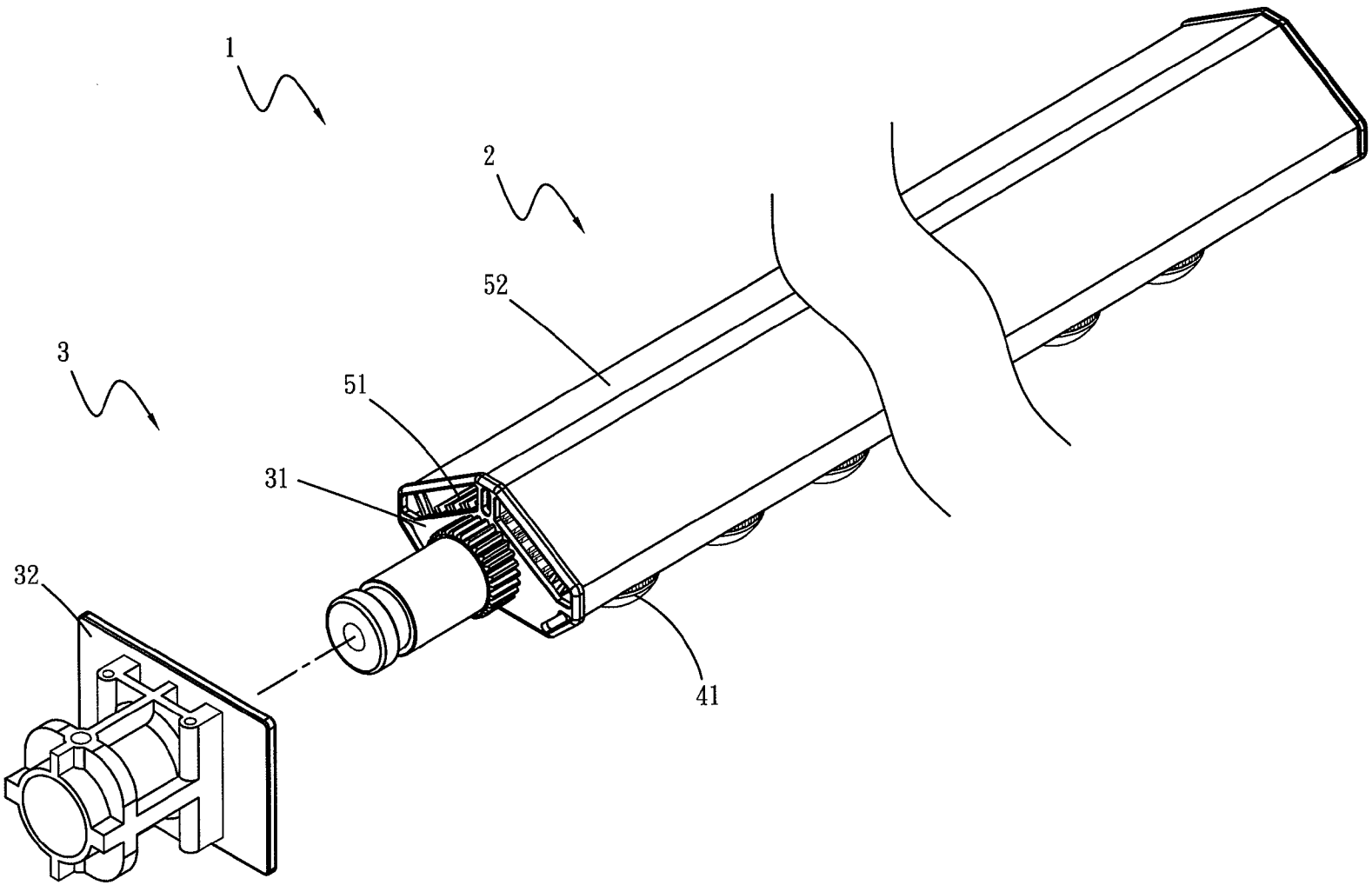
FIG. 1 is a perspective view of the invention.

Please refer to FIGS. 1 through 5, the present invention provides an LED lamp 1 which at least includes an LED lamp set 2 and an adjustment assembly 3. The LED lamp set 2 includes an LED set 4 and a cooling set 5.

The LED set 4 includes at least one LED lamp element 41 and a holder 42. The LED lamp element 41 includes:

a light bulb 43 which is an LED lighting element;

a coupling boss 44 which has a clamp 441 at an upper side to hold the light bulb 43, a lower end formed external threads 442 on the periphery, a first trough 443 inside, and two first electrode passages 444 and 445 on the periphery thereof;

two first conductive elements 45 are respectively formed in a column which can be bendable; the two first conductive elements 45 have upper ends running through the first electrode passages 444 and 445 to form electric connection with the light bulb 43;

a lamp shade 46 which has a second trough 461 with internal threads formed therein and an opening 462 in the center of the bottom run through by the coupling boss 44 for fastening therewith;

a lamp shell 47 which has external threads 471 screwed with the second trough 461 of the lamp shade 46 to form coupling therewith; and a wiring member 48 which is held in the first trough 443 of the coupling boss 44 and has two second electrode passages 481 and 482 close to the axis and periphery thereof run through by the two first conductive elements 45.

The LED lamp element 41 further includes two second conductive elements 49 formed in columns with upper ends fastened to lower ends of the first conductive elements 45 and lower ends formed respectively a flange 491.

For assembly, clip the light bulb 43 in the clamp 441 of the coupling boss 44 with the two first conductive elements 45 running through the first electrode passages 444 and 445 to form electric connection with the light bulb 43; after the coupling boss 44 is run through and fastened to the opening 462 of the lamp shade 46, screw the lamp shell 47 and lamp shade 46 together with the lower ends of the two first conductive elements 45 running through the second electrode passages 481 and 482 and dispose the wring member 48 in the first trough 443 of the coupling boss 44; and connect the upper ends of the two second conductive elements 49 to the lower ends of the two first conductive elements 45 to finish assembly of the LED lamp element 41.

Referring to FIGS. 2, 4, and 6 through 8, the holder 42 includes a board 420, and also at least one socket 421, at least one base board 422 and at least one buffer 423. The board 420 is formed integrally through aluminum extrusion and has at least one aperture 424 to hold the socket 421 and a plurality of second fastening holes 425 and third fastening holes 426 to fasten the cooling set 5 and adjustment assembly 3. The socket 421 is held in the aperture 424 on the board 420 and includes a third trough 427 with a screw hole formed therein and through holes 428 at the bottom run through by external power cords (not shown in the drawings). The base board 422 is a printed circuit board held in the third trough 427 of the socket 421 and has two electrode circuits 4221 and 4222 respectively formed in the center and periphery and connected to the mating flanges 491 of the two second conductive elements 49. The buffer 423 is made of silica gel and interposed between the third trough 427 and the base board 422 to provide cushion during assembly, and has two apertures 429 run through by two external power cords (not shown in the drawings).

After assembly of the holder 42 is finished, the LED lamp element 41 is screwed in the third trough 427 of the socket 421 through the external threads 442 of the coupling boss 44, and the flanges 491 of the second conductive elements 49 form electric connection with the two electrode circuits 4221 and 4222 of the base board 422 held in the third trough 427. The buffers 423 provide cushion during screwing to prevent damage of the elements caused by excessive forces. The two external power cords (not shown in the drawings), after run through the two through holes 428 of the socket 421 and apertures 429 of the buffers 423, form electric connection with the base board 422 by soldering.

The cooling set 5 is coupled with the LED set 4, referring to FIGS. 2, 6, and 9 through 12, and at least includes a radiation fin 51 formed integrally through aluminum extrusion in a rhombic or arched shape to evenly disperse heat of the LED lamp element 41 to ambient air in the event that an air fan system is absent. The radiation fin 51 has a plurality of fastening holes (not shown in the drawings) formed at two sides thereof mating the second fastening holes 425 of the board 420 to be fastened therewith through fastening elements such as screws (not shown in the drawings). The radiation fin 51 and holder 42 are interposed by an airflow passage communicating two sides thereof to facilitate cooling.

Figure 2:
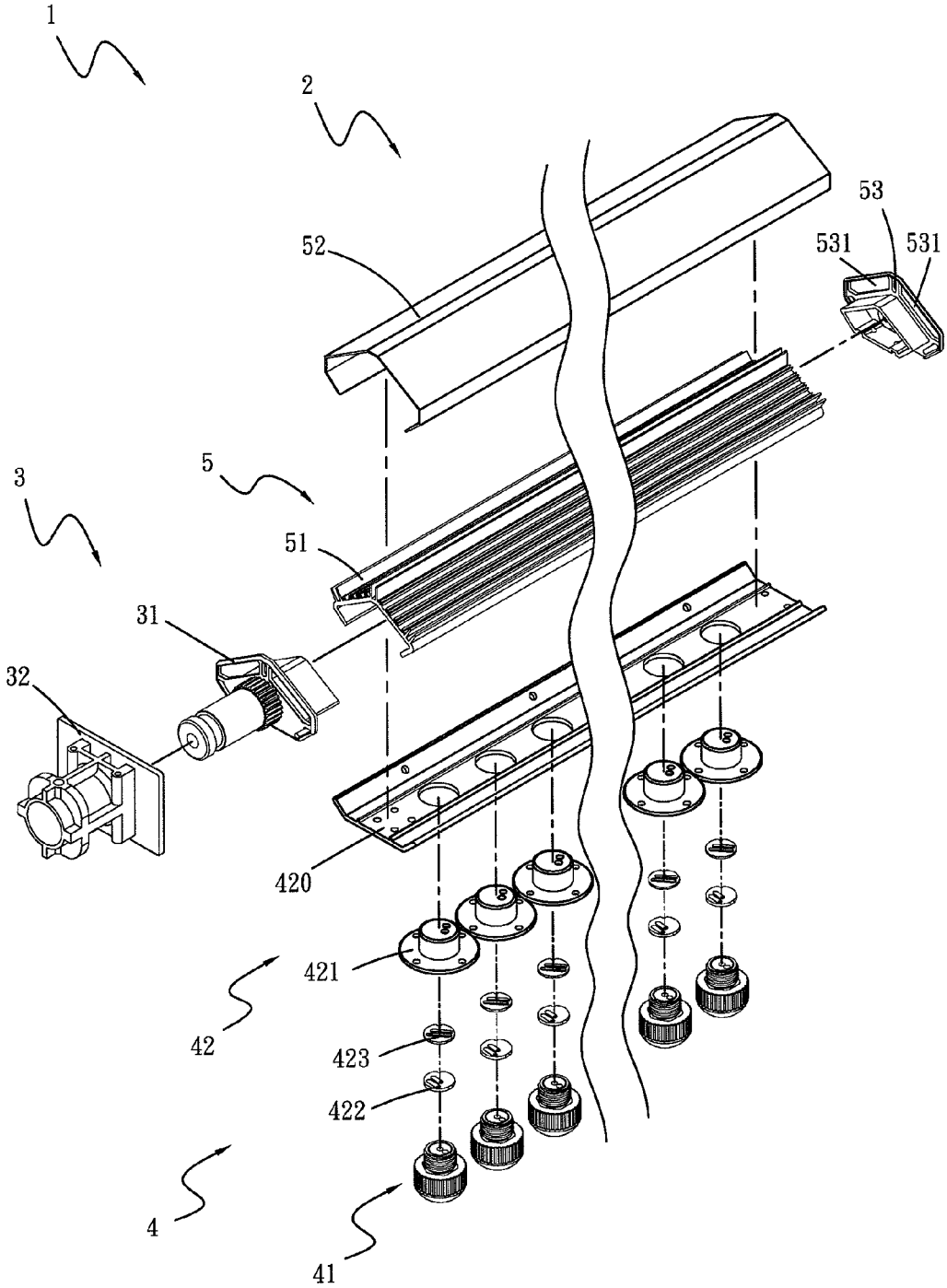
FIG. 2 is an exploded view of the invention.
Figure 3:
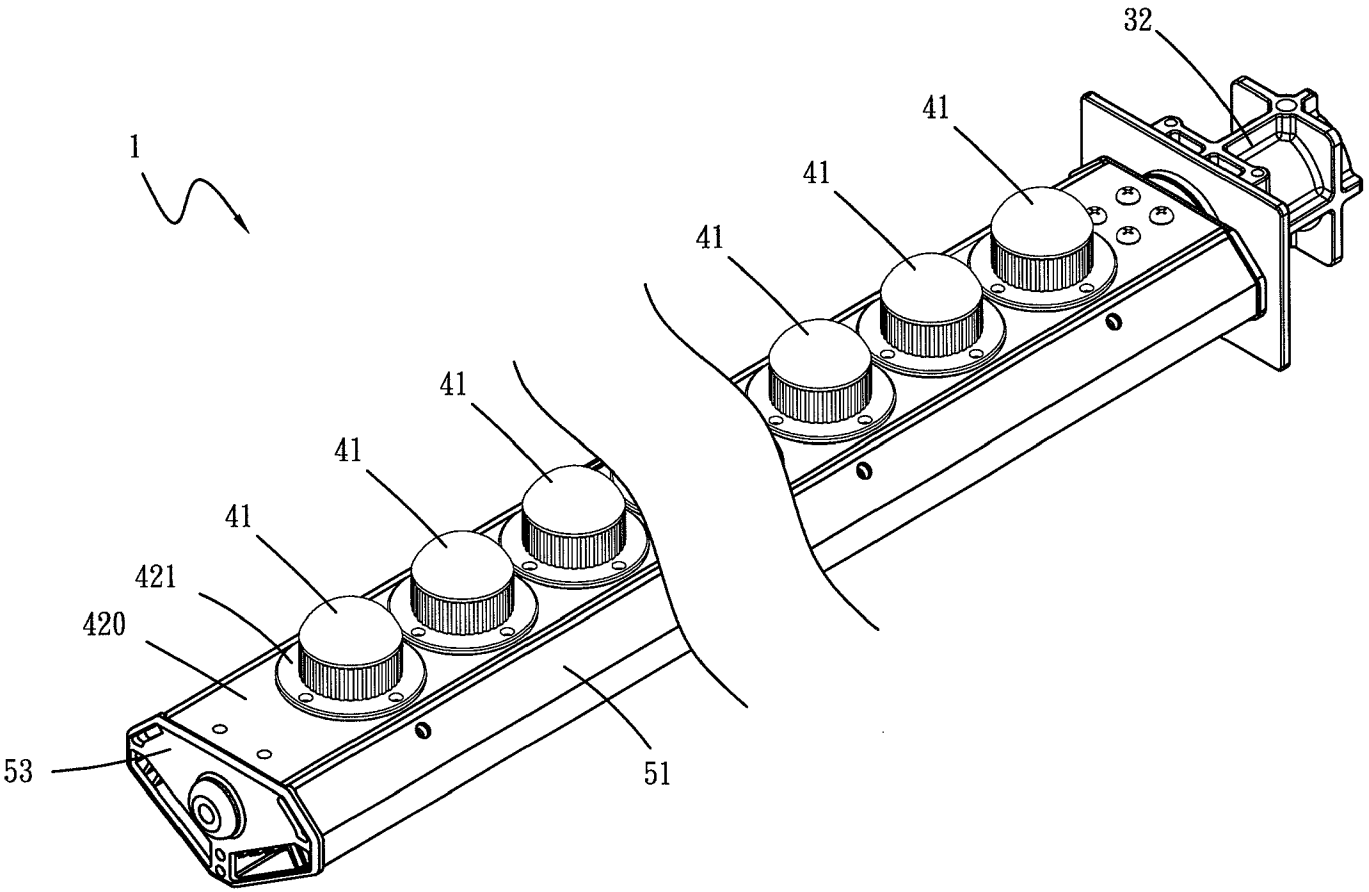
FIG. 3 is another perspective view of the invention.
Figure 4:
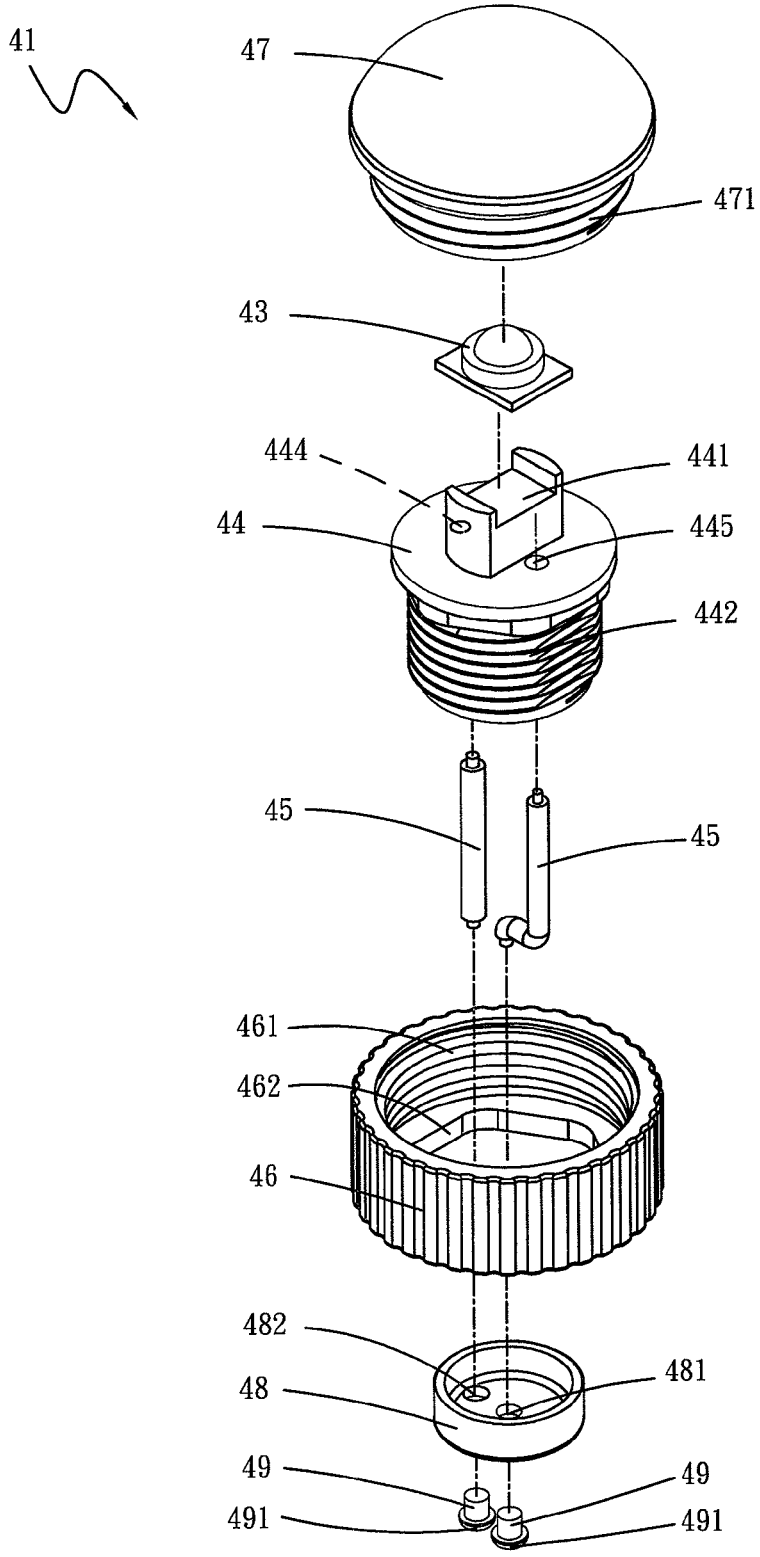
FIG. 4 is an exploded view of the LED lamp element.
Figure 5:
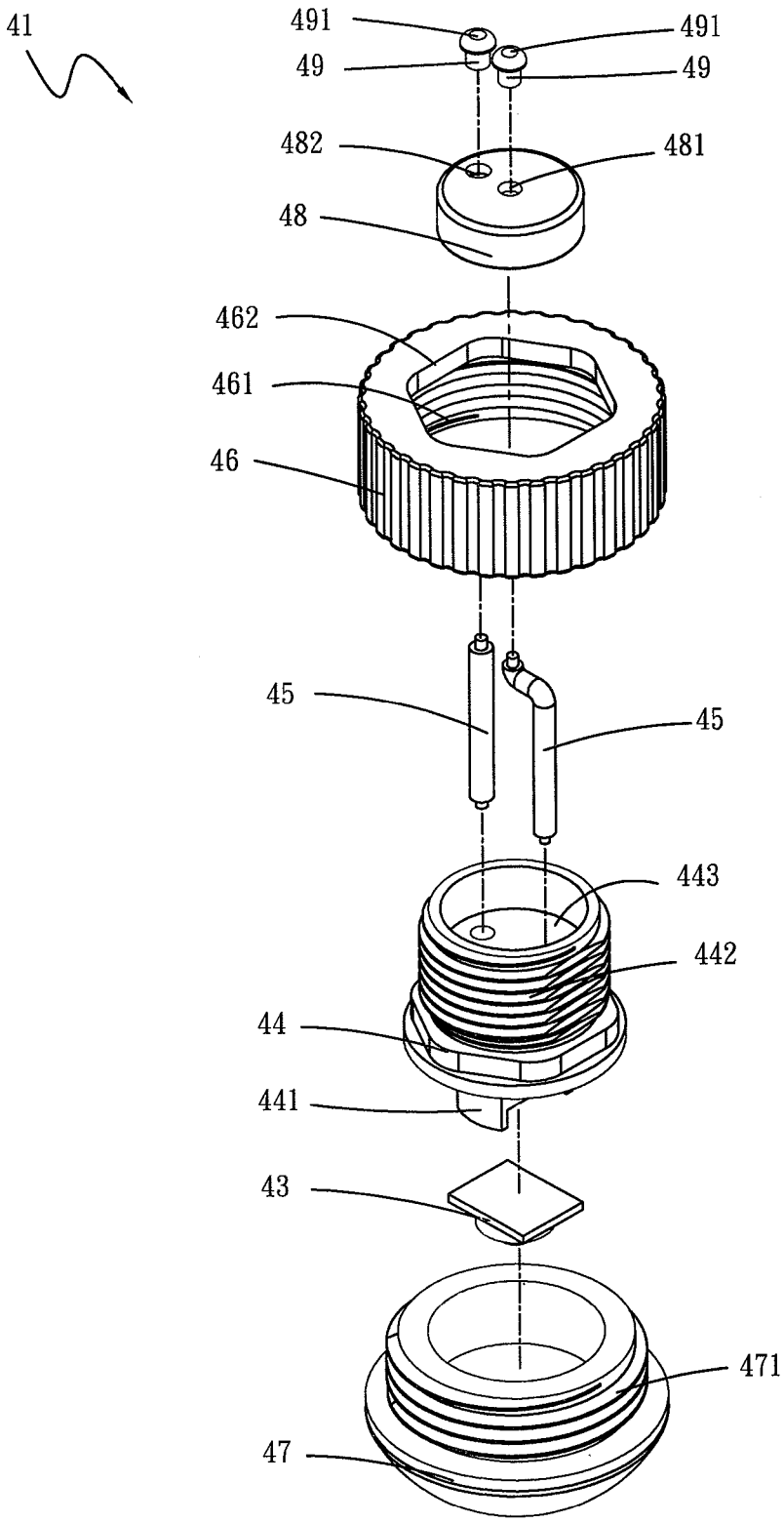
FIG. 5 is another exploded view of the LED lamp element from another angle.
Figure 6:
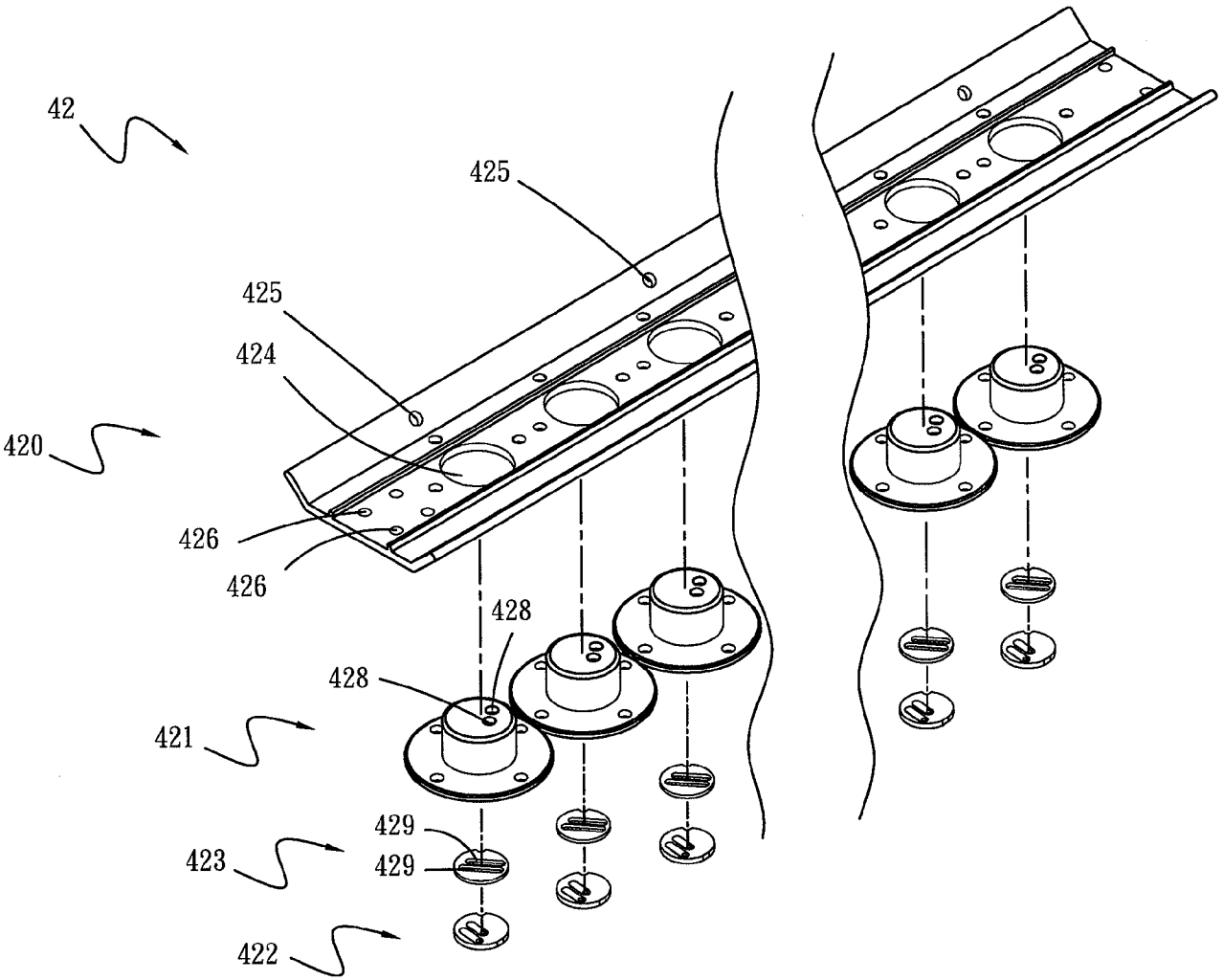
FIG. 6 is an exploded view of the holder.
Figure 7:
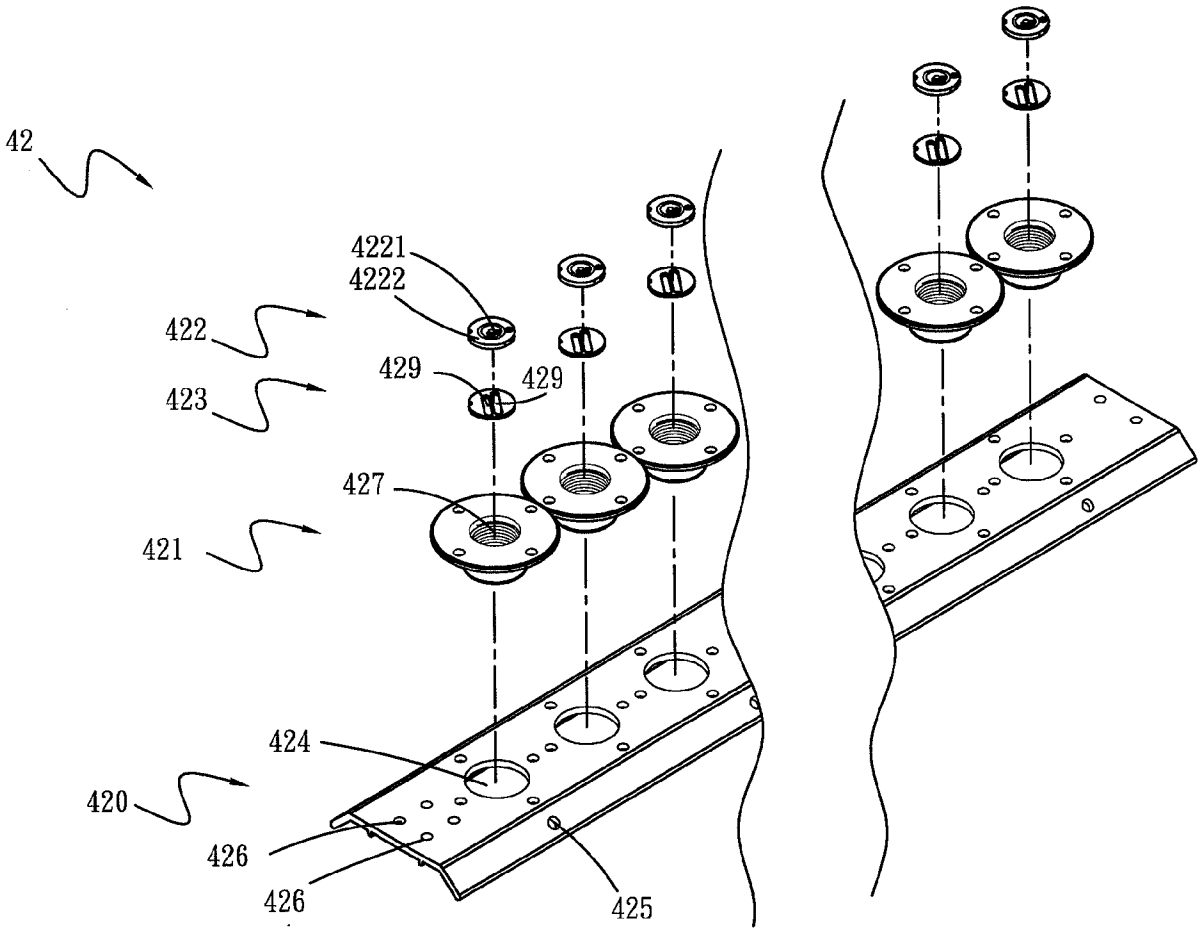
FIG. 7 is another exploded view of the holder from another angle.
Figure 8:
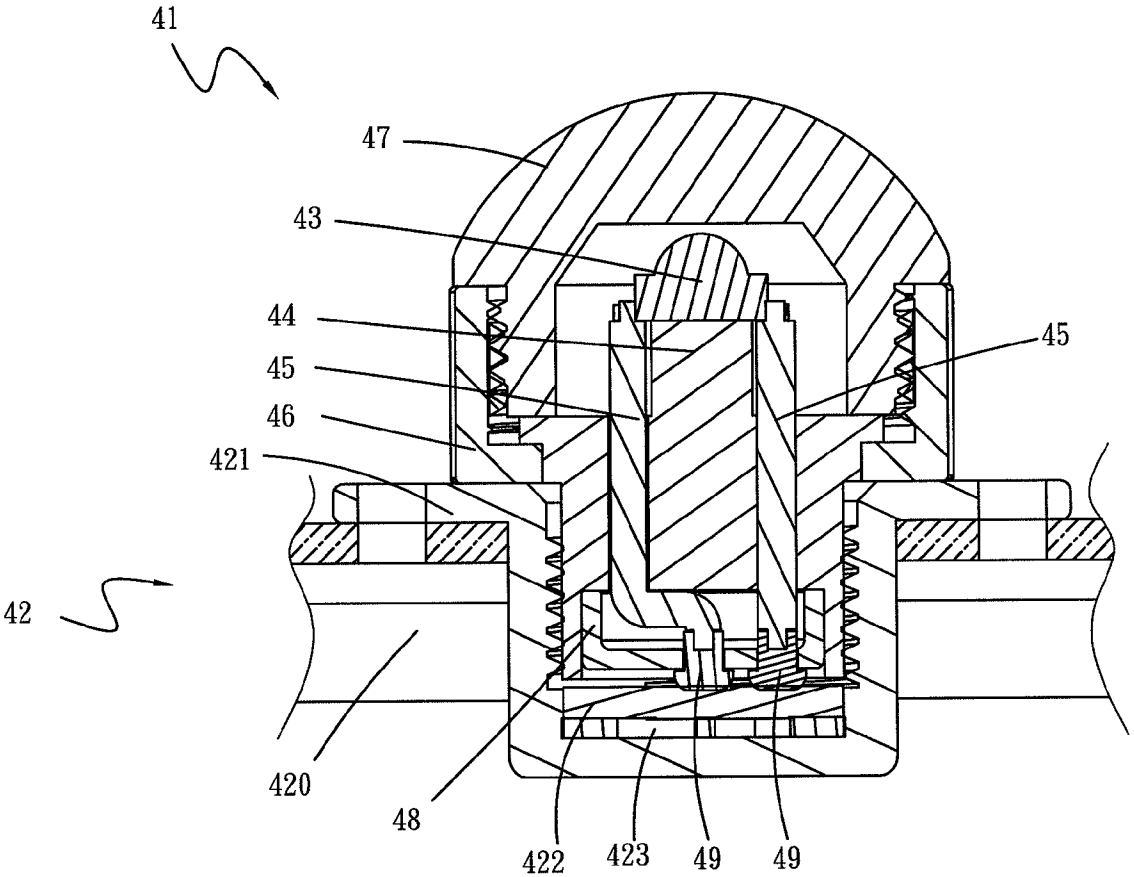
FIG. 8 is a sectional view of the LED lamp element and holder in a coupled condition.
Figure 9:
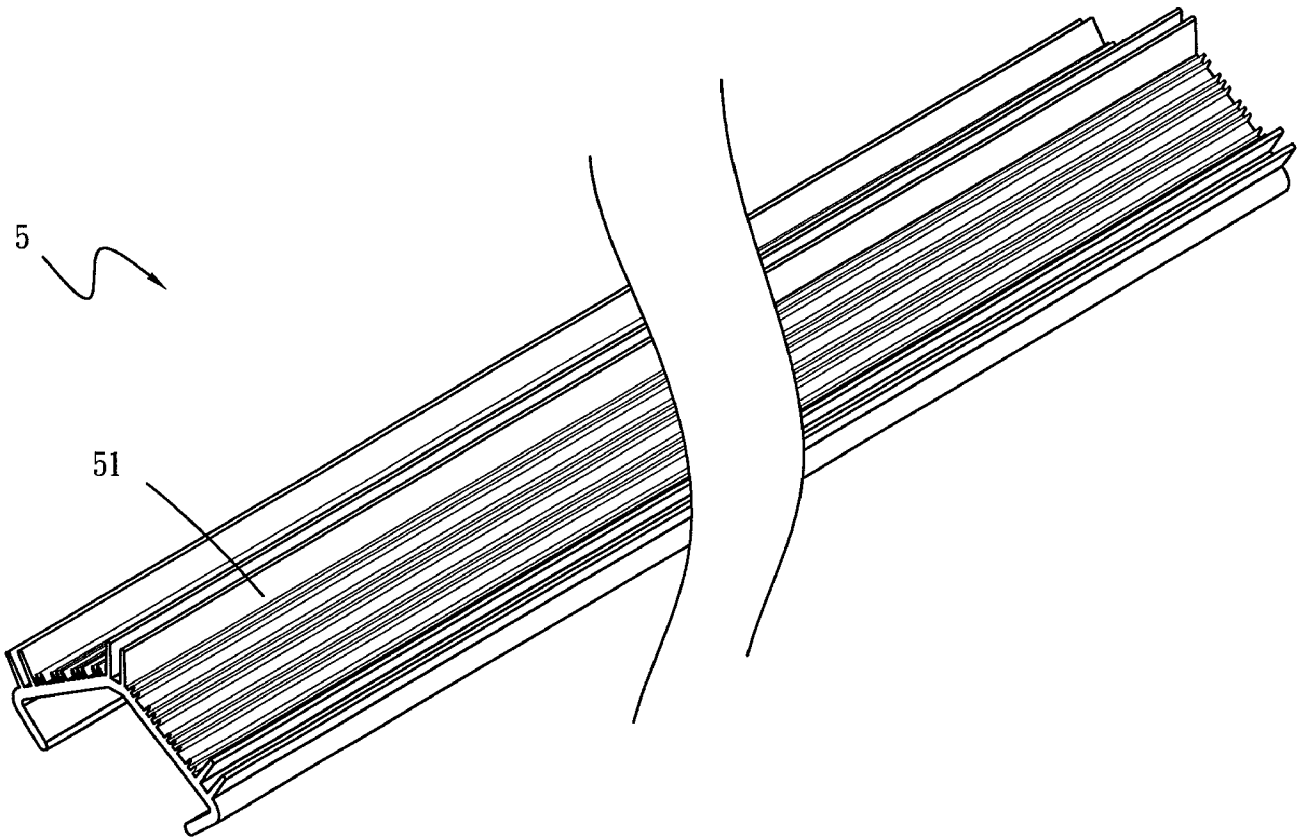
FIG. 9 is a perspective view of a radiation fin of the invention.
Figure 10:
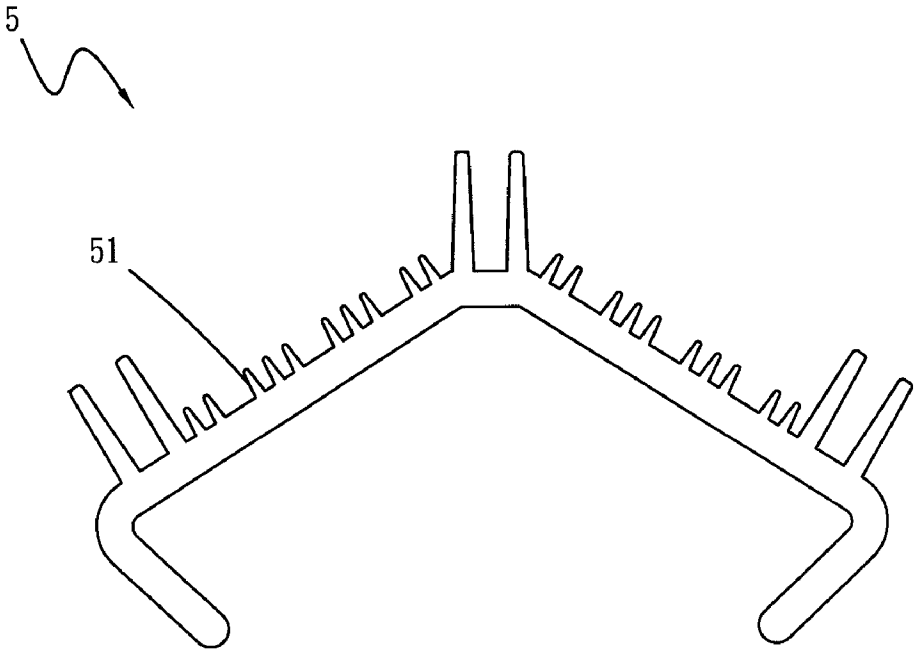
FIG. 10 is a front view according to FIG. 9.
Figure 11:
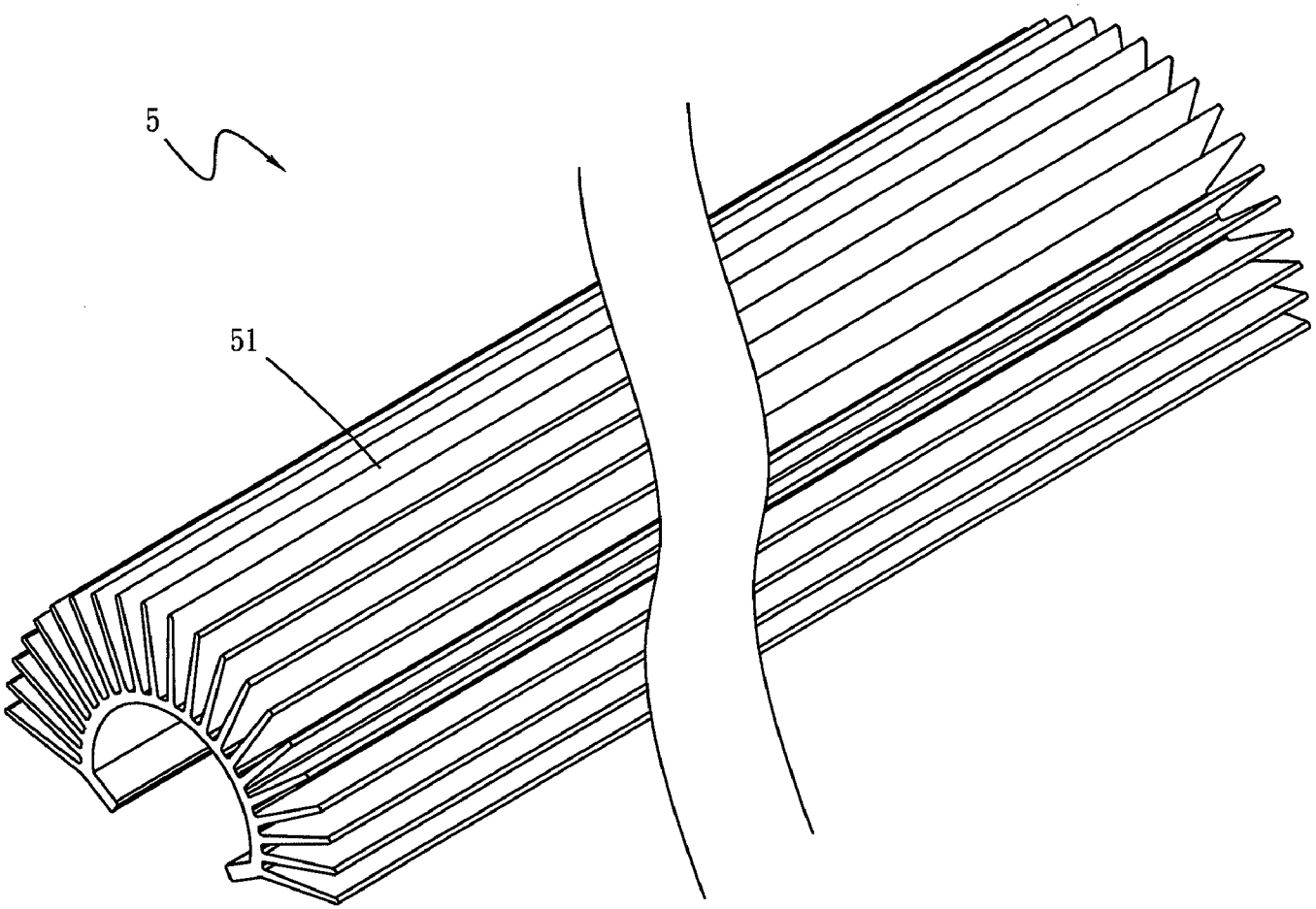
FIG. 11 is a perspective view of another radiation fin of the invention.
Figure 12:
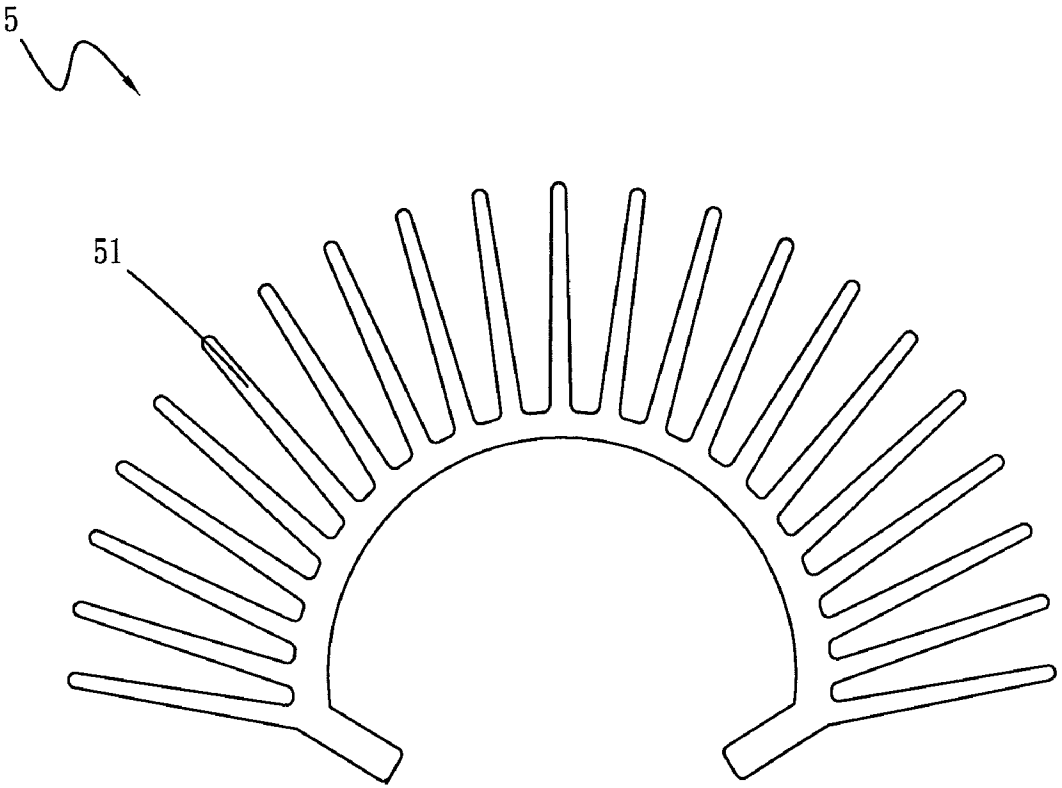
FIG. 12 is a front view according to FIG. 11.
Figure 13:
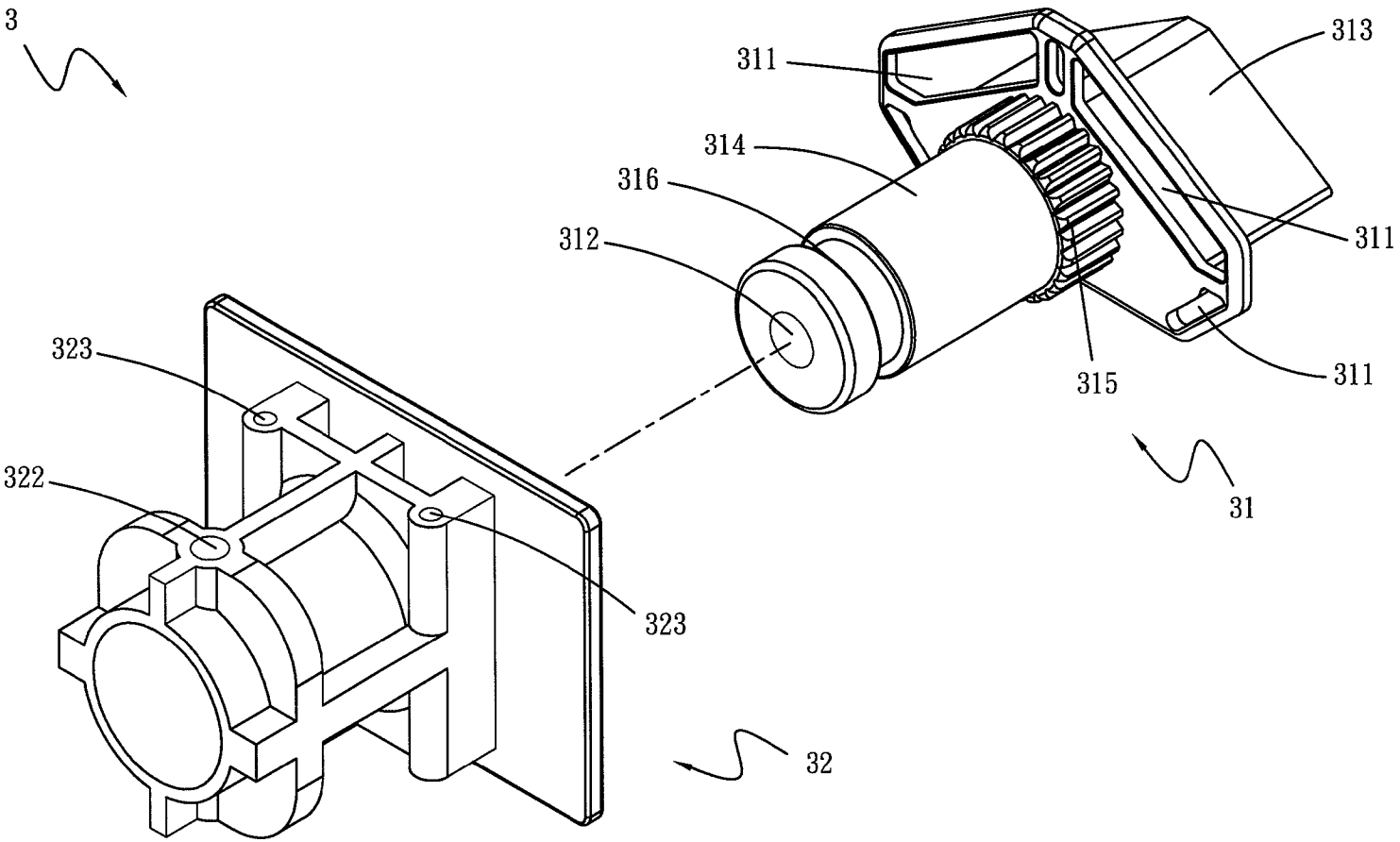
FIG. 13 is an exploded view of the adjustment assembly of the invention.
Figure 14:
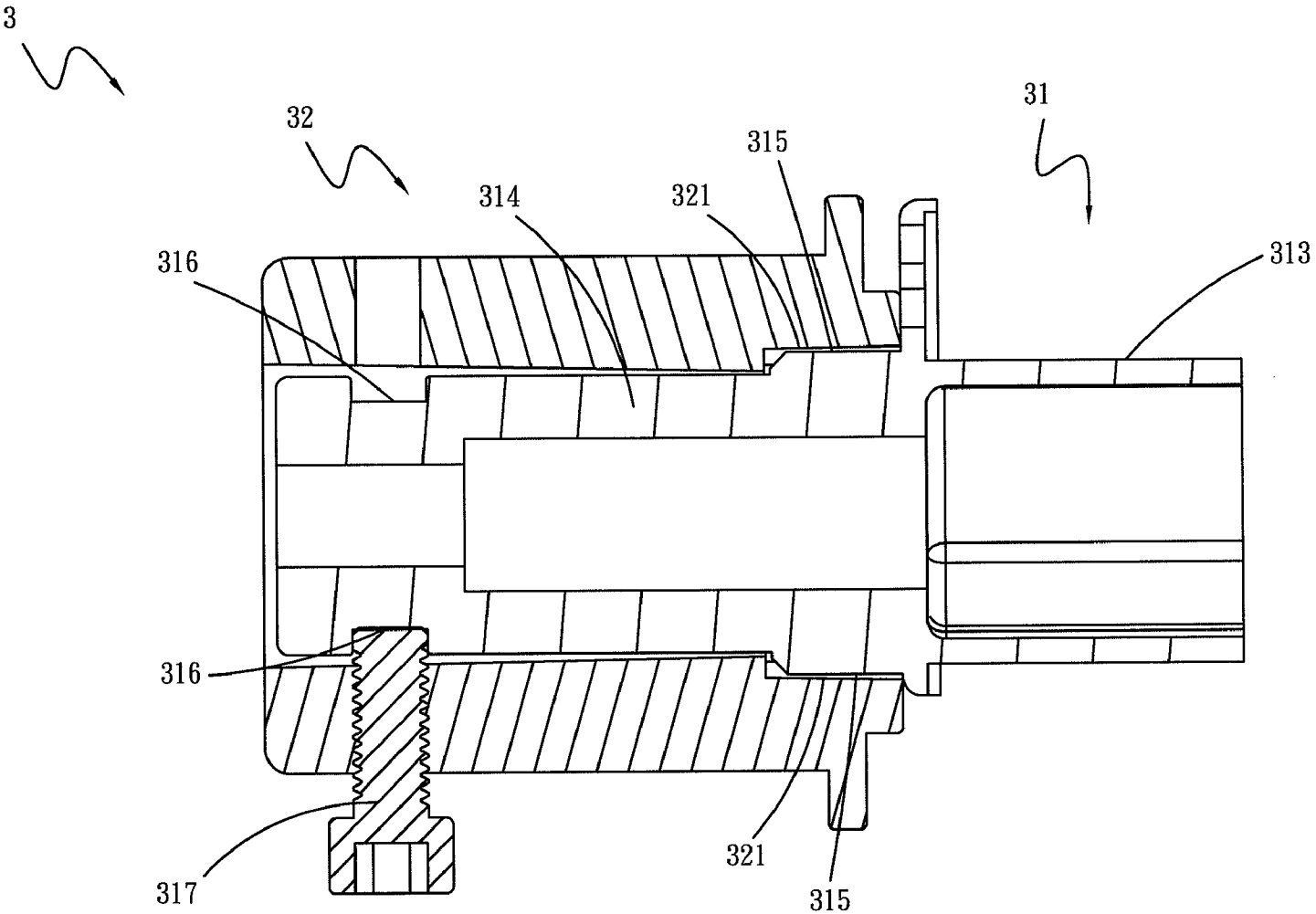
FIG. 14 is a sectional view of the adjustment assembly of the invention.
Figure 15:
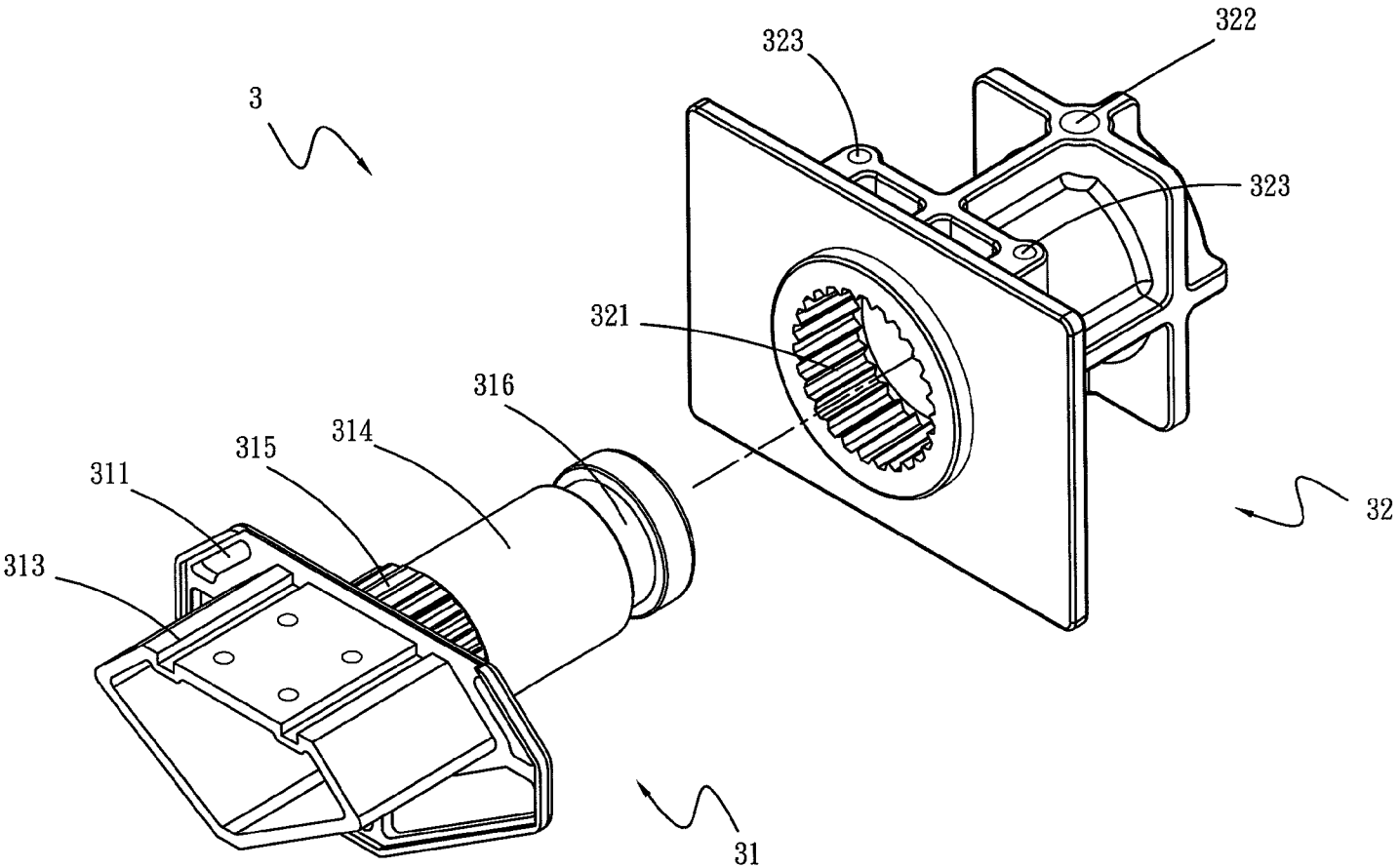
FIG. 15 is another exploded view of the adjustment assembly from another angle.
Figure 16:
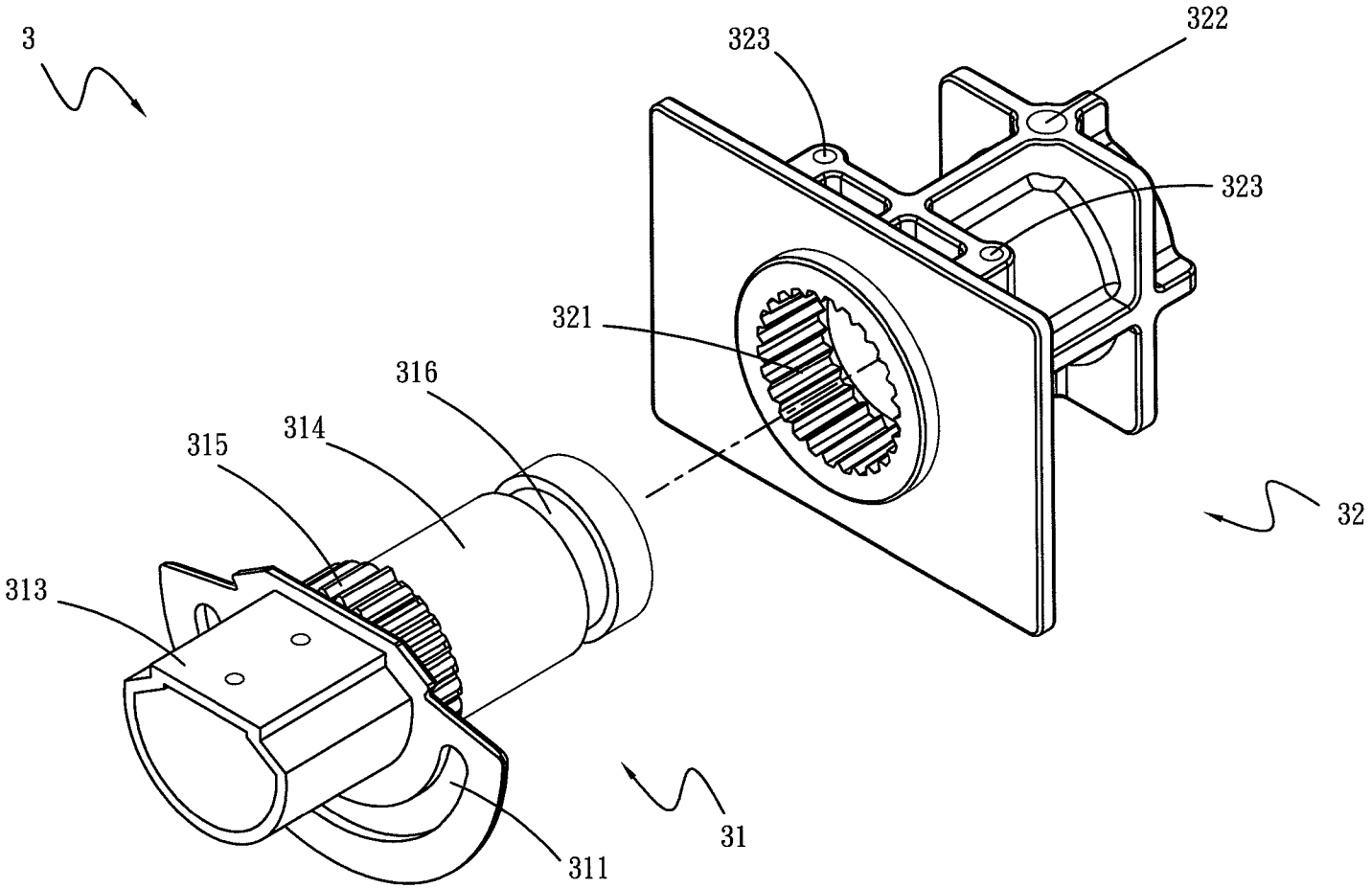
FIG. 16 is an exploded view of another adjustment assembly coupled with the radiation fin in FIG. 11.
Figure 17:
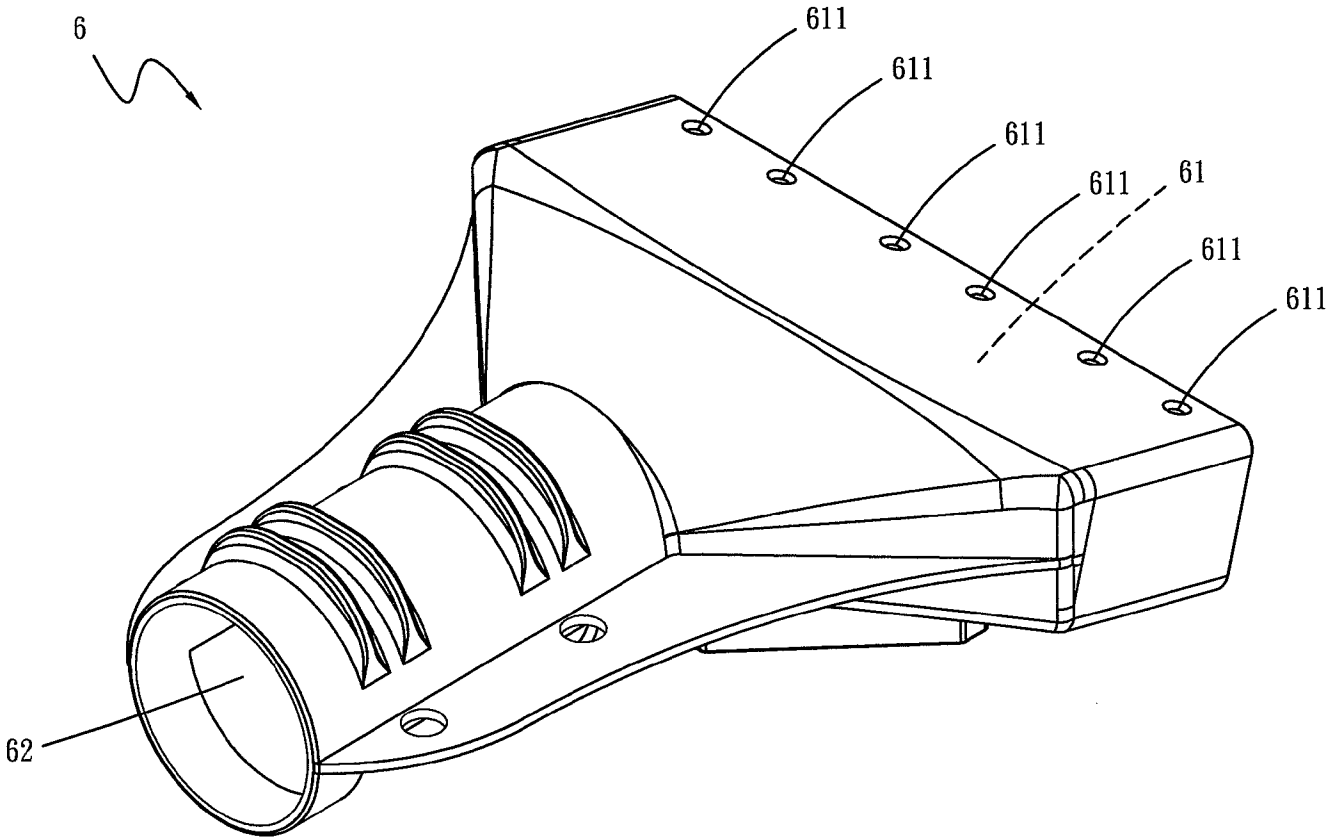
FIG. 17 is a perspective view of the assembly dock of the invention.
Figure 18:
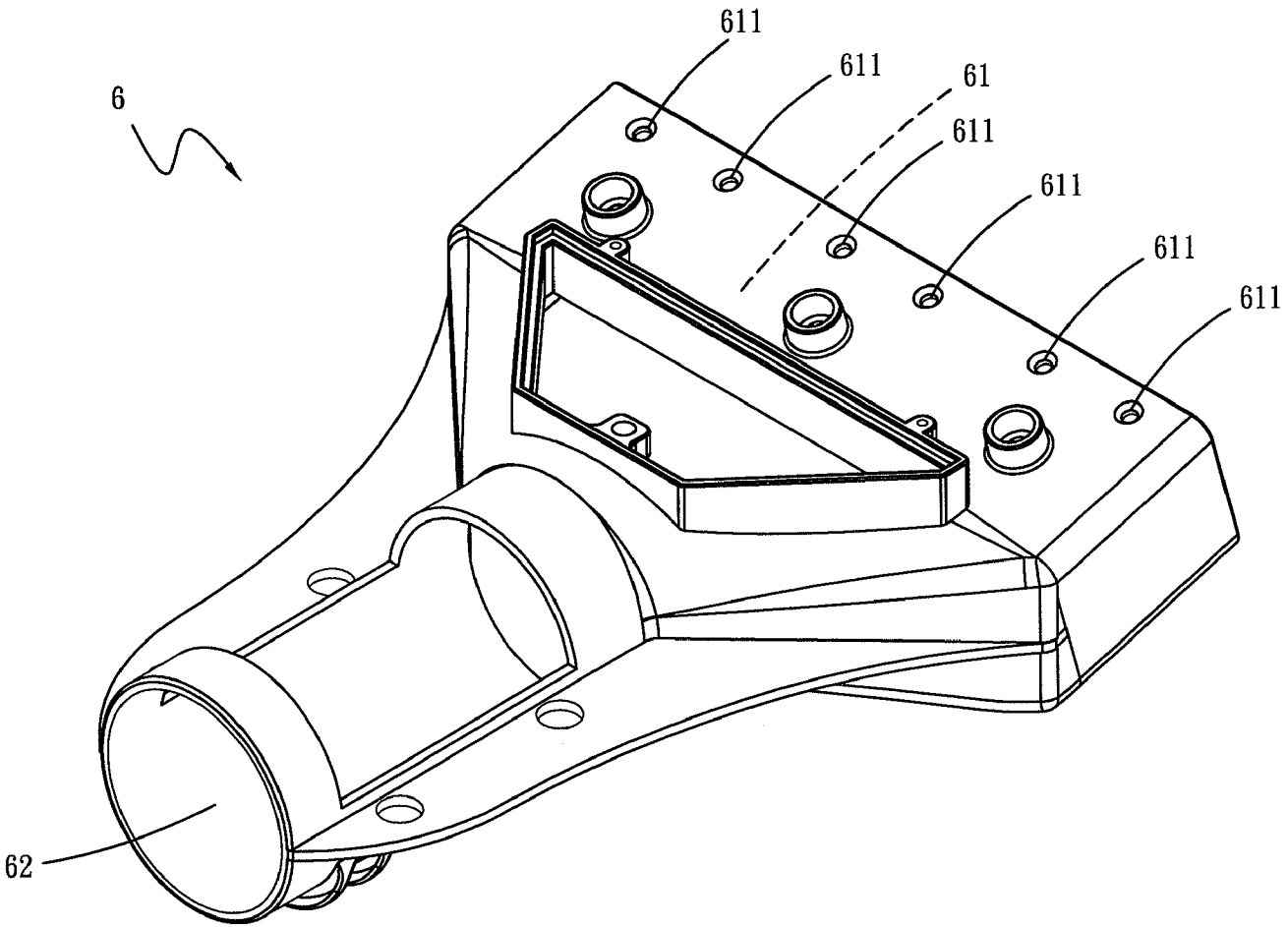
FIG. 18 is another perspective view of the assembly dock of the invention from another angle.

The cooling set 5 further includes a casing 52 and a side cap 53 (referring to FIG. 2). The casing 52 is located above the radiation fin 51 to facilitate cooling, dust-fending and raindrop-guarding. The side cap 53 has a plurality of first air vents 531 on the periphery and covers one side of the airflow passage to prevent entering of insects and the like into the air passage that might impact cooling effect.

The adjustment assembly 3 is coupled with the LED set 4 and cooling set 5, referring to FIGS. 2, 7, and 13 through 16. It at least includes an adjustment member 31 and an adjustment holder 32. The adjustment member 31 is located at one side of the airflow passage which is formed by coupling the holder 42 and the radiation fin 51, and has a plurality of second air vents 311 on the periphery to facilitate air ventilation and an orifice 312 in the center run through by the external power cords (not shown in the drawings), and also has an anchor portion 313 extended from one side entering into one side of the airflow passage to fasten the LED set 4, and can be fastened to the third fastening holes 426 of the board 420 through fastening elements (not shown in the drawings) such as screws. The adjustment member 31 has a cylindrical adjustment stem 314 extended from another side to form a mating male and female engaging structure with the adjustment holder 32. The adjustment stem 314 has a teeth-shaped male engaging portion 315 close to an inner side thereof and an annular groove 316 on the circumference close to an outer side thereof to be wedged and butted by an anchor element 317 such as a screw.

Figure 19:
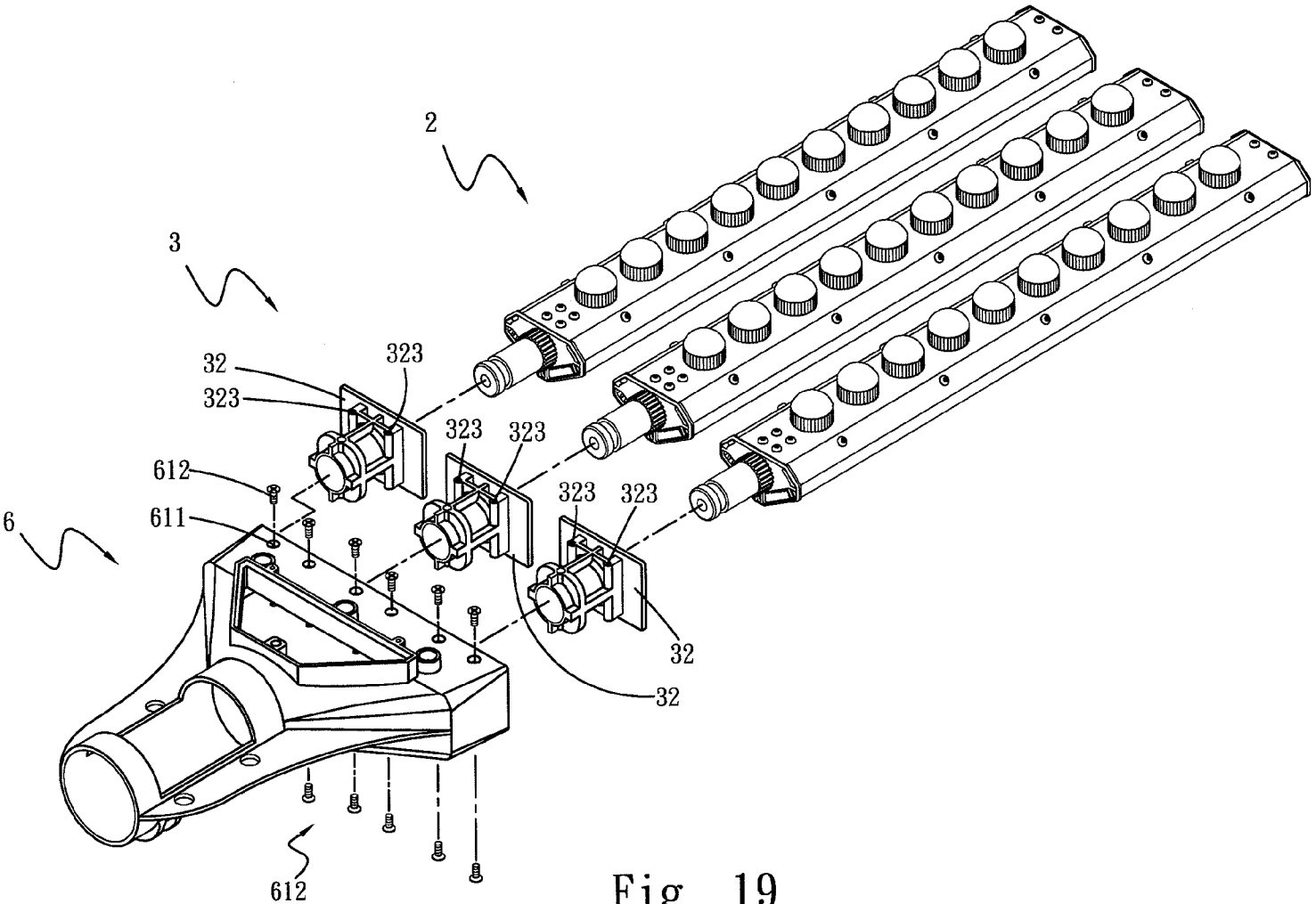
FIG. 19 is an exploded view of an embodiment of the invention with three LED lamp sets and adjustment assemblies coupled with an assembly dock.
Figure 20:
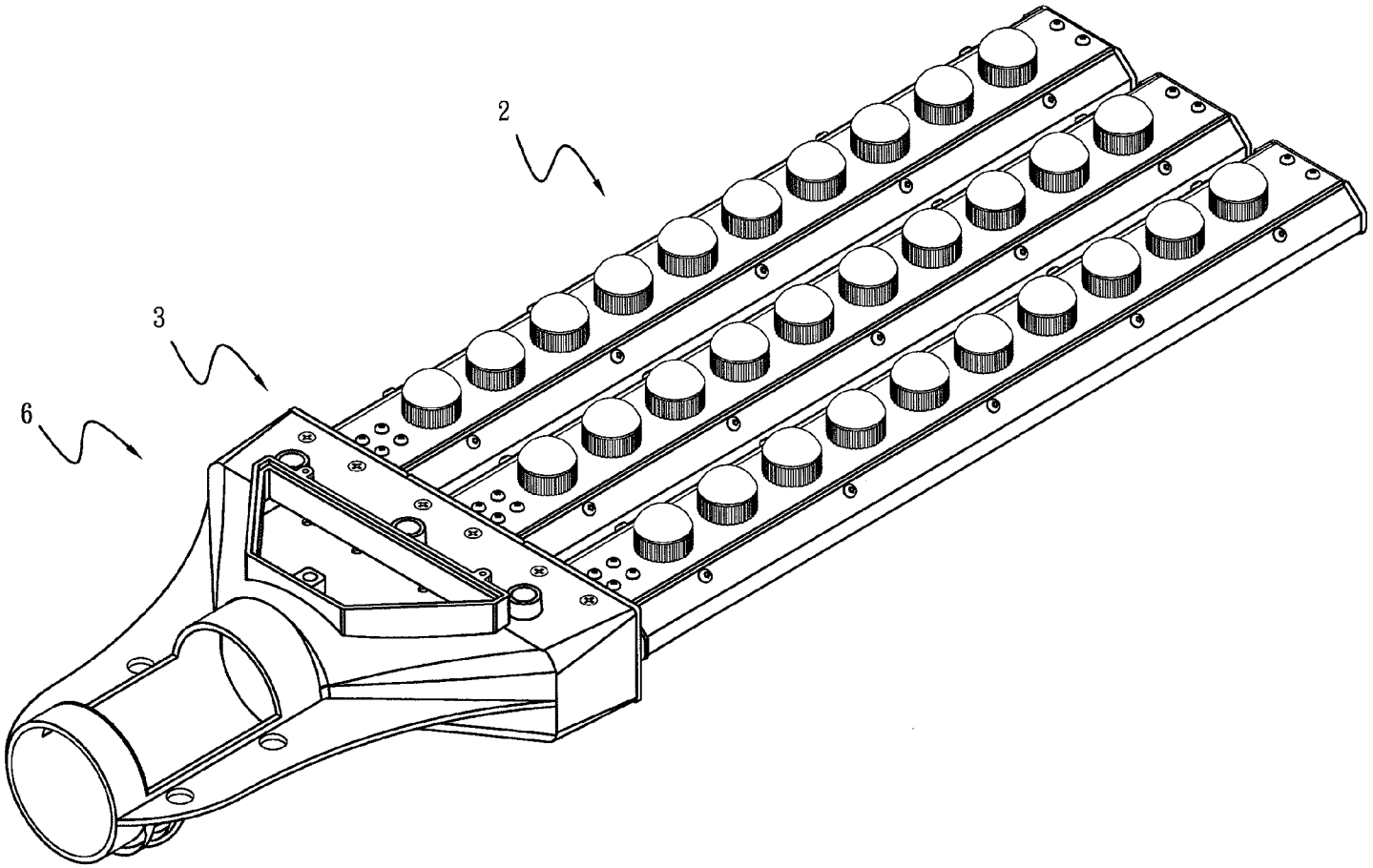
FIG. 20 is a perspective view of an embodiment of the invention with three LED lamp sets and adjustment assemblies coupled with an assembly dock.

The adjustment holder 32 is a female engaging structure mating the adjustment stem 314, and includes a teeth-shaped female engaging portion 321 inside, a first fastening hole 322 and a plurality of second fastening holes 323 on an outer side. The first fastening hole 322 corresponds to the annular groove 316 of the adjustment stem 314. When the adjustment stem 314 is inserted into the adjustment holder 32, the male engaging portion 315 and the female engaging portion 321 are engaged. The anchor element 317 runs through the first fastening hole 322 to butt the annular groove 316 to form a firm coupling of the adjustment member 31 and adjustment holder 32. The second fastening holes 323 are used to fasten the assembly dock (referring to FIG. 19).

After the adjustment assembly 3 and LED lamp set 2 are assembled, if adjusting light illumination angle is desired, unfasten the anchor element 317 to disengage the male engaging portion 315 and the female engaging portion 321; turn and adjust the engaging angle between them until reaching a desired angle, and engage the male engaging portion 315 and the female engaging portion 321 again and fasten them together through the anchor element 317. Then light illumination can be achieved as desired.

Refer to FIGS. 17 through 20 for the LED lamp 1 of the invention that further includes an assembly dock 6 which can be coupled with a plurality of LED lamp sets 2 and adjustment assemblies 3 according to requirements, and can be fabricated through a molding process. In this embodiment, three sets of the LED lamp sets 2 and adjustment assemblies 3 are provided. The assembly dock 6 has a cavity 61 at a rear end formed at an inclined angle according to requirements. The adjustment holders 32 of the adjustment assembly 3 are held and coupled in the cavity 61. The cavity 61 has an upper and lower end that have respectively a plurality of third fastening holes 611 formed thereon to receive fastening elements 612 such as screws to fasten to the second fastening holes 323 of the adjustment holders 32 to form secure coupling. The assembly dock 6 has a hole 62 at the front end to couple with an electric wire pole or lamp pole (not shown in the drawings) to mount the assembled LED lamp 1 thereon.

Figure 21:
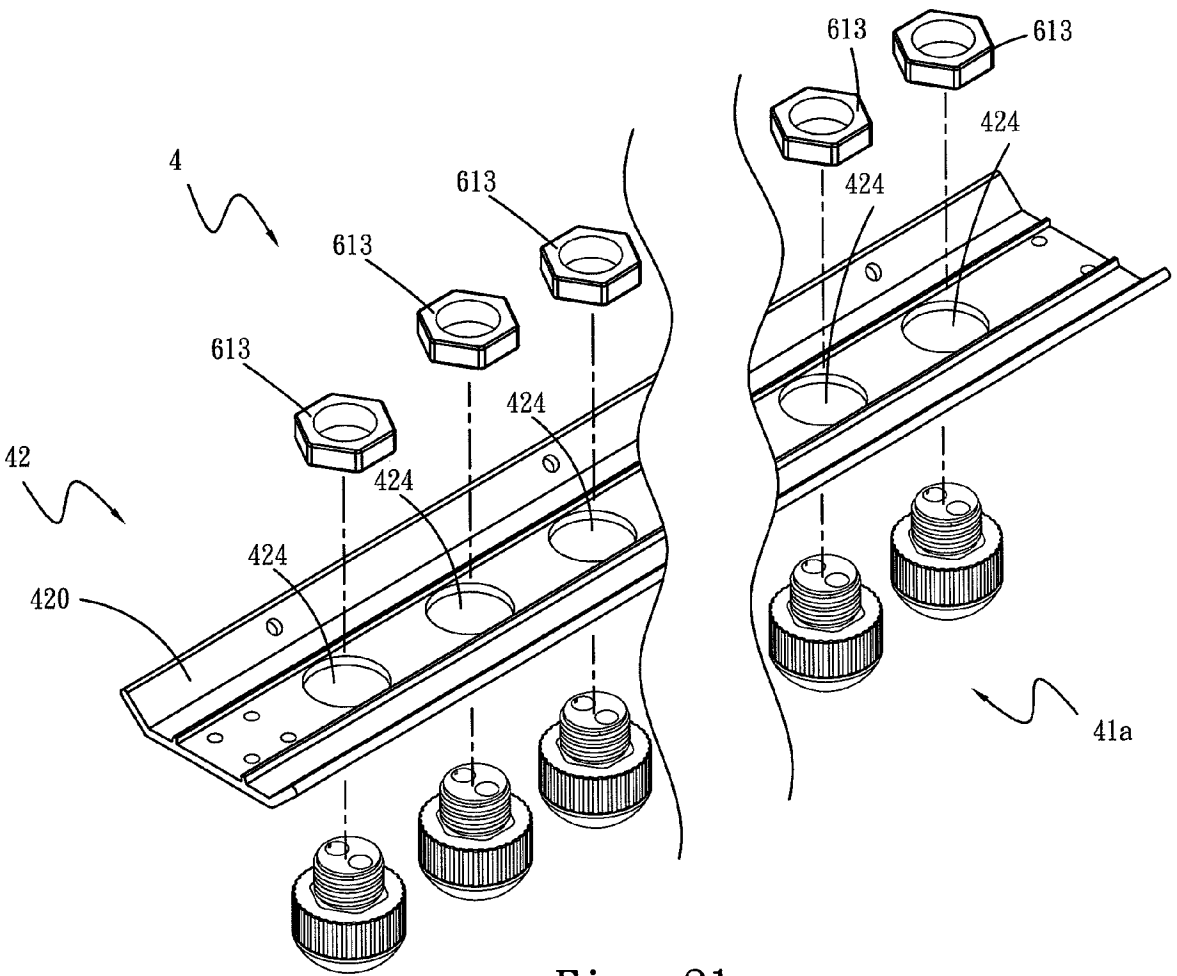
FIG. 21 is an exploded view of another embodiment of the invention incorporating with U.S. patent application Ser. No. 12/558,228 entitled "Improved LED lamp electrode structure" submitted by the Applicant.

Refer to FIG. 21 for another embodiment of the invention. The LED set 4 includes at least one LED lamp element 41*a* and a holder 42. The LED lamp element 41*a* adopts the structure disclosed in U.S. patent application Ser. No. 12/558,228 entitled "Improved LED lamp electrode structure" submitted by the Applicant. The holder 42 includes a board 420 with apertures 424 formed thereon to hold the LED lamp element 41*a*, and is fastened through fastening elements 613 such as nuts to form secure coupling between the LED lamp element 41*a* and board 420.

What is claimed is:

1. An LED lamp, at least comprising an LED lamp set and an adjustment assembly; the LED lamp set including an LED set and a cooling set; the LED set including at least one LED lamp element and a holder;

wherein the LED lamp element includes:

a light bulb which is an LED lighting element;

a coupling boss which includes a clamp to hold the light bulb;

two first conductive elements respectively formed in a column including an upper end electrically connected with the light bulb;

a lamp shade which includes a second trough inside and an opening in the center of the bottom thereof to fasten the coupling boss;

a lamp shell to engage with the second trough of the lamp shade; and a wiring member which includes two second electrode passages close to the axis and periphery thereof run through by the two first conductive elements;

wherein the holder includes:

a board which includes at least one aperture;

at least one socket which is held in the aperture of the board and includes a third trough;

at least one base board which is a printed circuit board held in the third trough of the socket and includes electrode circuits in the center and periphery thereof connected to the LED lamp element; and at least one buffer interposed between the third trough and the base board to provide cushion during assembly;

wherein the cooling set includes at least one radiation fin to couple with the holder of the LED set to form an airflow passage;

wherein the adjustment assembly is coupled with the LED set and the cooling set.

2. The LED lamp of claim 1, wherein the LED lamp element further includes two column-shaped second conductive elements which respectively include an upper end fastened to a lower end of each of the two first conductive elements and a lower end formed a flange.

3. The LED lamp of claim 1, wherein the coupling boss includes two first electrode passages run through by the two first conductive elements.

4. The LED lamp of claim 1, wherein the buffer is made of silica gel.

5. The LED lamp of claim 1 further including an assembly dock which includes a cavity on a rear end to hold and couple with the adjustment assembly and a hole on a front end to engage with an electric wire pole or a lamp pole.

* * * * *